US006043833A

United States Patent [19]

Cavarero et al.

[11] Patent Number: 6,043,833

[45] Date of Patent: Mar. 28, 2000

[54] THERMAL PRINTING RIBBON FOR AN OFFICE COLOR PRINTER

[75] Inventors: Eric Cavarero, Conflans Sainte Honorine; Pascal Boishardy, Santeuil, both of France

[73] Assignee: Sagen SA, Paris, France

[21] Appl. No.: 09/122,090

[22] Filed: Jul. 24, 1998

[51] Int. Cl.[7] ..... B41J 31/00

[52] U.S. Cl. ..... 347/217; 400/237; 400/240; 400/240.4

[58] Field of Search ..... 347/217; 400/237, 400/240, 240.3, 240.4

[56] References Cited

U.S. PATENT DOCUMENTS 4,250,511 2/1981 Stein et al. .
5,274,544 12/1993 Iida .

FOREIGN PATENT DOCUMENTS 59-101385 11/1984 Japan .
08183192 7/1996 Japan .
2148193A 5/1985 United Kingdom .
2311257A 9/1997 United Kingdom .

*Primary Examiner*—Huan Tran
*Attorney, Agent, or Firm*—Nixon & Vanderhye PC

[57] ABSTRACT

The invention concerns a thermal printing ribbon for an office printer and bearing a sequence of coloring areas (3–7) that serve to print a picture in at least one printing zone onto a printing support sheet of specified format. The formats of the consecutive coloring areas (3–7) that serve to print a printing zone are substantially sub-multiples of the format of the printing support sheet but significantly different one from another.

The invention is appropriate for color printing by thermal transfer.

3 Claims, 1 Drawing Sheet

THERMAL PRINTING RIBBON FOR AN OFFICE COLOR PRINTER

FIELD OF THE INVENTION

The present invention relates to color printing a printing sheet support by thermal transfer, thermal sublimation or other modes of thermal printing.

BACKGROUND OF THE INVENTION

Thermal color printers consume a ribbon which bears a sequence of sets of coloring areas.

Each set of coloring areas in general comprises three consecutive color areas resp. cyan, magenta and yellow, each area being the size of a sheet to be printed.

To print a color picture on a page of a support sheet, the three areas of a set of areas are consecutively applied to the page by activating the heater elements of a printing head. In this manner the color picture is reconstituted by superposing the cyan, magenta and yellow colors.

Accordingly printing a page consumes systematically three coloring pages regardless of the size of the picture to be printed, entailing ribbon waste for instance when printing only a few lines of the page.

SUMMARY OF THE INVENTION

The objective of the invention is to regulate the consumption of coloring ribbon in relation to the size of the picture to be printed while avoiding printing defects.

For that purpose the invention relates to a thermal printing ribbon for an office printer, said ribbon bearing a sequence of coloring areas used to print a picture in at least one printing zone on a printing support sheet of a specific format and being characterized in that the formats of the coloring zones substantially are sub-multiples of the format of the printing support sheet while being substantially different from one another.

Thanks to this design, the junction defects between the consecutively printed zones are smoothed.

Advantageously the formats of the consecutive coloring areas serving to print a printing zone are decreasing.

The invention is elucidated by the following description of a particular embodiment of the printing ribbon of the invention and of a particular implementing mode of the thermal color printing procedure, in relation to the attached drawings.

DETAILED DESCRIPTION OF THE PREFERRED EMBODIMENTS

Figure 1:
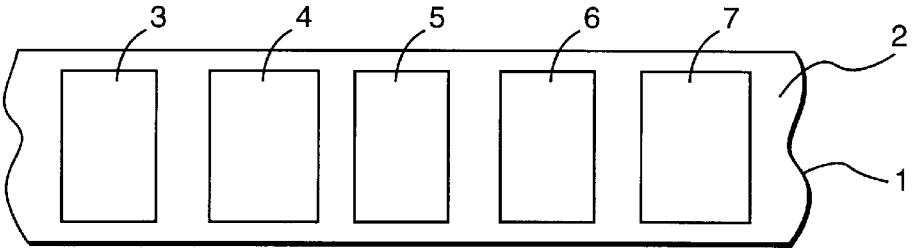
FIG. 1 is a topview of the printing ribbon.
Figure 2:
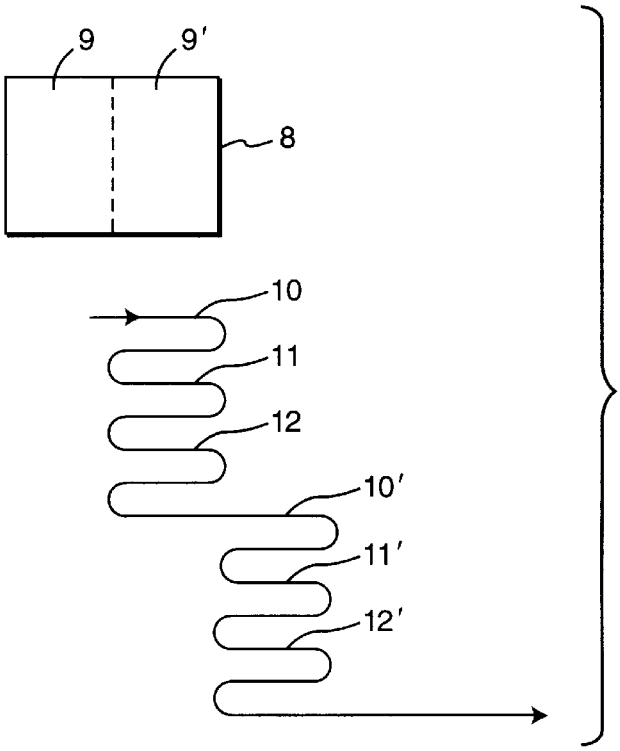
FIG. 2 is a diagrammatic view of the motion of a printing support sheet during printing.

The printing ribbon 1 now to be described will be consumed in an office color printer using thermal transfer.

In this embodiment the ribbon 1 comprises a polyethylene film 2 bearing a sequence of coloring areas 3 through 7 of different colors consisting of pigmented resin layers.

The ribbon 1 is divided into a plurality of sets of areas 4 through 6, each set serving to print a printing zone of a support sheet and comprising a plurality of consecutive areas of different colors, in this case three resp. color areas cyan, magenta and yellow.

The ribbon serving to print printing support sheets of a specified format, in this instance of A4 standard format (21 cm×29.7 cm), the coloring areas here assume a format substantially half the standard A4 format, in other words the A5 format (21×14.85 cm), the small sides of the coloring areas running parallel to the ribbon edges. However the widths of the coloring areas 4 through 6 of each set of areas used in printing one impression zone of a printing support sheet are substantially different from each other and this instance these widths are decreasing. In other words, the formats of the consecutive coloring areas of each set of areas are substantially sub-multiples of the format of the sheet to be printed while being mutually different and sequentially decreasing. Thanks to this feature, the junctions between the printing zones can be smoothed in the manner elucidated further below.

The color thermal printing method corresponding substantially to the operation of the printer using the above-described printing ribbon is described immediately below.

In order to print a picture running over the full surface of a printing support sheet 8, the sheet is divided into two strips 9, 9' each being an A5 format.

The printing band enclosing the picture to be printed is determined from the above bands 9, 9'. In this particular embodiment, because the picture runs over the full printing support sheet 8, the two bands 9, 9' of the sheet 8 are printing bands.

Next each printing band 9 (9') is consecutively subjected to a sequence of printing runs 10, 11, 12 (10', 11', 12'). For each printing run, the band 9 (9') is driven round-trip and one color is printed during the first leg by applying a coloring area to the band and by activating heater elements of a printing head.

In this manner cyan, magenta and yellow color layers 13, 14, 15 are consecutively printed on one of the printing bands and then on the other, 9', thereby consuming six A5 format coloring areas, that is the equivalent of three A4 format coloring areas.

Figure 3:
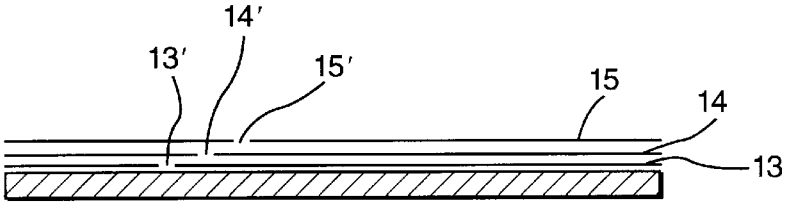
FIG. 3 is a cross-section of a junction between two printing zones. Detailed Description of the Preferred Embodiments

With respect to FIG. 3, the widths of the consecutive coloring areas of each set of areas being significantly different from each other and being decreasing, the junctions 13', 14', 15' between two layers of the same color 13, 14, 15 belonging to two adjacent printing bands will be mutually offset. In this manner the junction between the two printing zones 9, 9' are smoothed by avoiding creating a junction defect such as a white line.

In case the picture runs only in one printing band, the printing band is subjected only to the three consecutive runs to print the cyan, magenta and yellow colors. In that case only the three substantially A5 format coloring areas will be consumed.

In the above description, the sheet was divided into two bands 9, 9': however it may also be divided into a plurality of zones of a format equal to a sub-multiple of that of the sheet to be printed. In such a case the formats of the consecutive coloring pages would be substantially equal to the format of the impression zones, in other words to a sub-multiple of the format of the sheet to be printed, but substantially different from one another.

Instead of being decreasing, the formats of the consecutive coloring pages used to print a printing zone may also be increasing.

Lastly the invention also applies to thermal-sublimation or to any other thermal printing method.

we claim:

1. A thermal printing ribbon for an office printer bearing a sequence of coloring areas (3–7) that are used to print a picture in at least one printing zone on a printing support sheet of specified format, wherein the formats of the coloring areas (3–7) substantially are sub-multiples of the format of the printing support sheet but significantly different one from another.

2. Thermal printing ribbon for an office printer bearing a sequence of coloring areas (3–7) that serve to print a picture in at least one printing zone onto a printing support sheet of specified format, wherein the formats of the consecutive coloring areas (3–7) that serve to print a printing zone are substantially sub-multiples of the format of the printing support sheet but are significantly different one from another and are decreasing.

3. Thermal printing ribbon for an office printer bearing a sequence of coloring areas (3–7) that serve to print a picture in at least one printing zone onto a printing support sheet of specified format, wherein the formats of the consecutive coloring areas (3–7) that serve to print a printing zone are substantially sub-multiples of the format of the printing support sheet but are significantly different one from another and are increasing.

* * * * *

UNITED STATES PATENT AND TRADEMARK OFFICE

CERTIFICATE OF CORRECTION

PATENT NO. : 6,043,833
DATED : March 28, 2000
INVENTOR(S) : Eric CAVARERO et al.

It is certified that error appears in the above-identified patent and that said Letters Patent is hereby corrected as shown below:

Assignee : SAGEM S.A.
should read

Signed and Sealed this

First Day of May, 2001

*Attest:*

Nicholas P. Godici

NICHOLAS P. GODICI

*Attesting Officer*

*Acting Director of the United States Patent and Trademark Office*